United States Patent [19]

Doi et al.

[11] 4,194,095

[45] Mar. 18, 1980

[54] FLUID FLOW CONTROL SPEAKER SYSTEM

[75] Inventors: Toshitada Doi, Yokohama; Akira Iga; Osamu Hamada, both of Tokyo; Jyoji Hukuda, Yokohama; Yuichiro Hamada, Tokyo, all of Japan

[73] Assignee: Sony Corporation, Tokyo, Japan

[21] Appl. No.: 867,508

[22] Filed: Jan. 6, 1978

Related U.S. Application Data

[63] Continuation-in-part of Ser. No. 765,387, Feb. 3, 1977, abandoned.

[30] Foreign Application Priority Data

Feb. 10, 1976 [JP] Japan ..... 51-13396

[51] Int. Cl.[2] ..... H04R 23/00

[52] U.S. Cl. ..... 179/113; 137/837

[58] Field of Search ..... 179/1 R, 101, 108 R, 179/113

[56] References Cited

U.S. PATENT DOCUMENTS

| | | | |
|---|---|---|---|
| 3,148,691 | 9/1964 | Greenblott | 137/815 |
| 3,339,569 | 9/1967 | Bauer et al. | 325/28 |
| 3,563,306 | 2/1971 | Osheroff | 165/22 |
| 3,648,987 | 3/1972 | Arikawa | 261/23 A |

*Primary Examiner*—George G. Stellar

*Attorney, Agent, or Firm*—Lewis H. Eslinger; Alvin Sinderbrand

[57] ABSTRACT

A fluid flow control system has a fluid source and plural flow pipes connected to the fluid source. Each of the pipes has an opening of a specific area corresponding to one of the bit orders of a PCM (Pulse Code Modulated) input signal. The flow-condition of the fluid through each of the pipes is controlled by the PCM signal without changing the PCM signal to an analog signal. The summation of the outflow from each of the pipes combines to produce an analog flow output signal in response to the PCM input signal.

11 Claims, 9 Drawing Figures

FLUID FLOW CONTROL SPEAKER SYSTEM

This is a continuation-in-part of application Ser. No. 765,387 filed Feb. 3, 1977, now abandoned.

BACKGROUND OF THE INVENTION

1. Field of the Invention

The present invention relates generally to a fluid flow control system, and is directed more particularly to a novel speaker system which is driven by a pluse code modulation signal to produce an acoustic output directly.

2. Description of the Prior Art

In general, prior art speakers have a very small acoustic radiation resistance. For example, the winding resistance of the voice coil of an electro-motive type of speaker is several thousand times as great as the acoustic radiation resistance of that speaker. Thus, the acoustic-conversion efficiency of such a speaker is reduced by thermal loss. The acoustic radiation resistance of an electro-static type of speaker that uses a vibrating plate as the electro-acoustical transducer element is very small as compared with the reactance component of the vibrating plate, which also results in mis-matching, and hence, in reduced efficiency.

In prior art speakers utilizing a vibrating plate, it is well-known that the vibrating plate is subjected to divided vibrations in various and complicated modes, so that the sound is distorted. In electro-motive speakers, a further distortion is produced by the non-linearity of the magnetic circuit of the speaker. In general, even if the vibrating plate of a speaker is designed to have as large a damping factor as possible, the vibrating plate has inerita. Therefore, when a pulse signal, for example, is fed to such a speaker, the acoustic output therefrom has a damped oscillation waveform.

As described above, prior art speakers have low efficiency and high distortion characteristics as compared with those of other acoustic components, and hence limit the possibility of improving the fidelity of the whole acoustic reproduction system.

Further, a reverse sound pressure is produced behind the vibrating diaphram of prior speakers, so that a large baffle plate is necessary to prevent the reverse phase sound pressure from being transmitted to the front side of the speaker. As a result, it is difficult to generate low frequency sounds by means of a small size speaker.

At present, a PCM technique is employed in the audio field. That is, an audio signal, such as a voice signal, a musical signal, or the like, is converted into a PCM pulse signal and then recorded and reproduced. According to this PCM technique, an audio signal can be reproduced with higher difelity than can the same signal recorded and reproduced by prior art analog treatment. However, even if the PCM technique is employed in recording and transmission systems, the reproduction system (speaker and so on) at the terminal end of the prior art reproduction system must be only by analog signal. Thus, it is still necessary to convert the PCM signal into an analog signal in the prior art.

Devices that utilize fluid flow in digital systems are known as fluidic devices. Certain basic fluidic devices are described in an article entitled "Fluid Amplifiers - New Dimension for Fluid Power," Henry Lefer, *Hydraulics & Pneumatics,* February, 1965, pp. 61-64.

OBJECTS AND SUMMARY OF THE INVENTION

An object of the present invention is to provide a speaker system which is free from the defects inherent in prior art speaker systems and which produces an acoustic output directly from a PCM pulse signal.

Another object of the invention is to provide a speaker system which has a much lower power loss and can perform an acoustic output conversion with greater efficiency and lower power consumption.

A further object of the invention is to provide a speaker system in which sound pressure can be reduced to zero instantaneously to produce a sound pressure waveform substantially the same as the original waveform.

A still further object of the invention is to provide a speaker system which produces no reverse phase sound pressure, employs no baffle plate and hence is capable of producing a sound of a low frequency with a small speaker size.

According to one aspect of the present invention, a system is provided which comprises a fluid source for supplying a fluid, a plurality of flow pipes each connected to the fluid source and each having a first opening for receiving fluid from the source and a second opening for emitting the fluid. The system also includes apparatus for controlling the flow-condition of fluid through each of the flow pipes, and electronic control circuits, including an input terminal supplied with a PCM input signal voltage for producing a signal for controlling the apparatus. The outflow of fluid per unit time at the second opening of each flow pipe corresponds to one order of bits of the PCM input signal.

Other objects, features and advantages of the present invention will become apparent from the following description taken in conjunction with the attached drawings.

DESCRIPTION OF THE PREFERRED EMBODIMENT

Figure 3A:
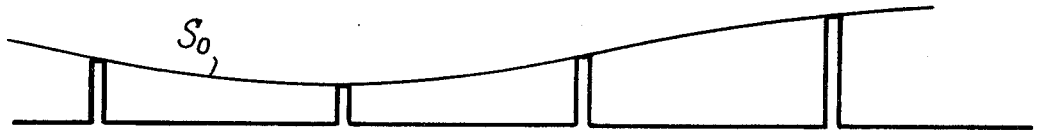
FIGS. 3A to 3G are waveform diagrams used for explanation of the signal system shown in FIG. 2.
Figure 3B:
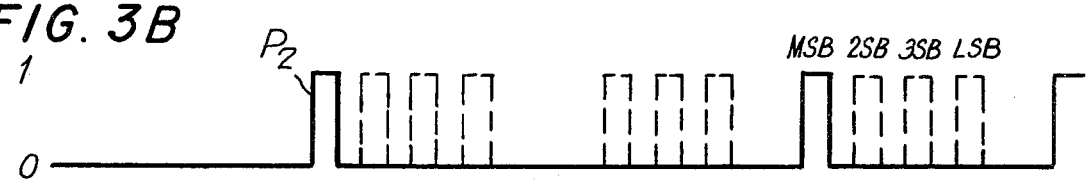

An example of a speaker system according to the present invention will be described with reference to the drawings. A PCM pulse signal voltage, which is used in the example of this invention, is prepared by sampling an audio signal $S_0$ by means of a pulse signal $P_1$ at a suitable frequency, as shown in FIG. 3A, and converting the respective pulse peaks of the sampled signal into one frame of a series pulse by an N-bit binary code. FIG. 3B shows the most significant bit pulses $P_2$ of the pulse signal for four frames in solid lines and shows the less significant bit signals for those frames in broken lines to indicate that they could have either the value "1" or the value "0", depending on the instantaneous value of the signal $S_0$ when it was sampled by the pulses $P_1$. In this example the number of bits in each frame is four (N=4), and the value of the PCM pulse is "0000" at the negative peak level of the original audio signal $S_0$ and "1111" at the positive peak level thereof.

Figure 1:
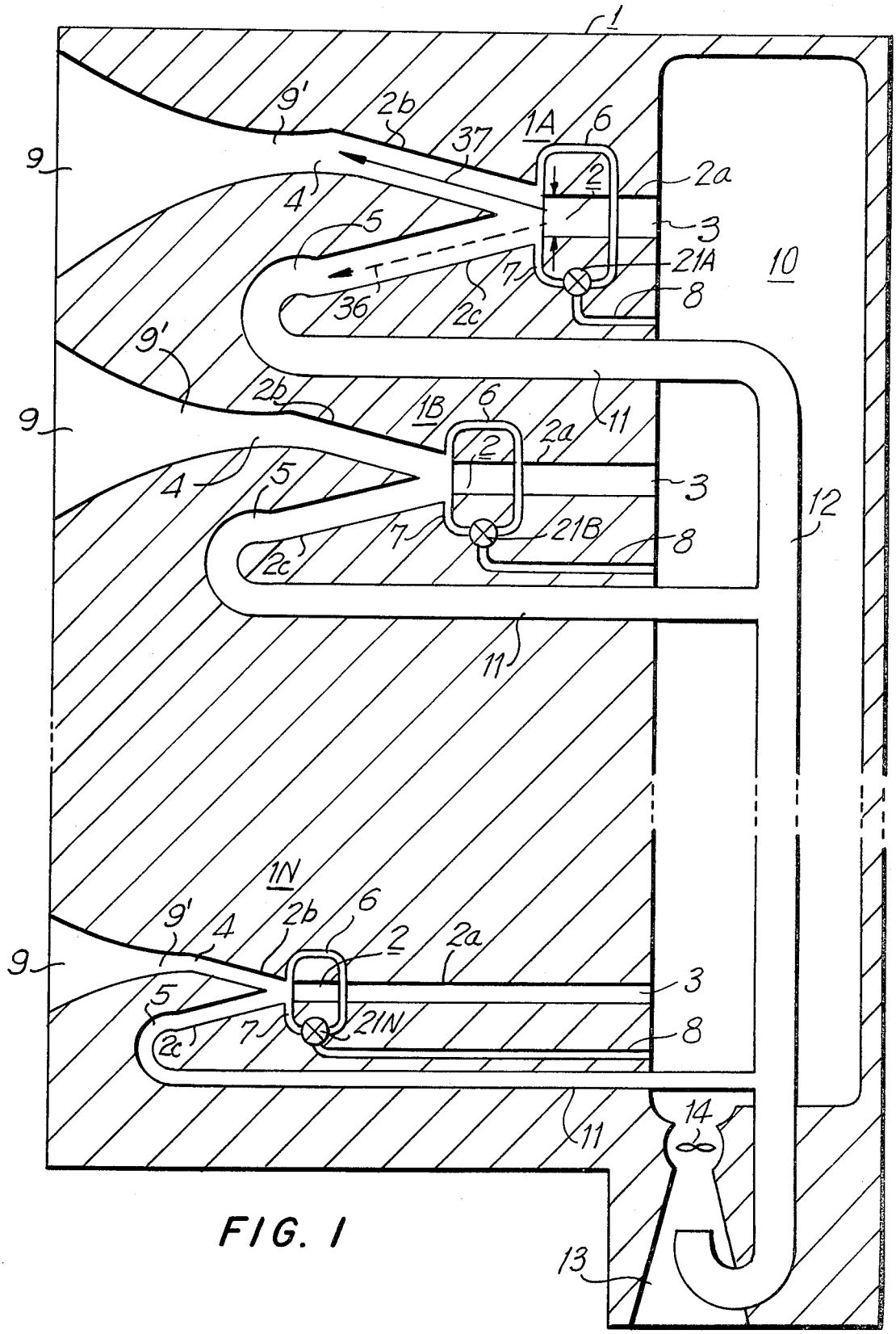
FIG. 1 is a cross-sectional view showing an example of a speaker system according to the present invention.

FIG. 1 shows an example of the speaker system of the invention including a speaker body 1 having a number of fluid operational elements 1A, 1B, . . . 1N that correspond, respectively, to the various bit orders from the most significant bit (MSB) pulse to the least significant bit (LSB) pulse in each frame of the PCM signal. The fluid operational elements 1A–1N may also be referred to as Coanda effect devices or as fluidic flip-flops.

Each of the elements 1A–1N has a flow path, or pipe, 2 which is generally Y-shaped and has three throats 2*a*, 2*b* and 2*c* connected together at a common point. One end of the throat 2*a* of each pipe 2 has an inlet 3 for receiving fluid, such as air, and the opposite ends of the throats 2*b* and 2*c* have outlets 4 and 5, respectively, through which the fluid can emerge from the pipes 2.

Two control fluid paths, or pipes, 6 and 7 are connected to each pipe 2 to control whether fluid entering by way of the respective throat 2*a* with emerge via the corresponding throat 2*b* and outlet 4 or via the corresponding throat 2*c* and outlet 5. To obtain such control over the flow of fluid through each pipe 2, the corresponding pipe 6 is connected into the pipe 2 at one side adjacent the common point of the three throats 2*a*–2*c*, and the corresponding pipe 7 is connected into the pipe 2 at the opposite side.

In accordance with this invention, the cross-sectional areas of the respective flow pipes 2 are so selected that the speed, or flow rate, of air flowing through the openings 4 of the N fluid operational elements 1A to 1N are equal, and the cross-sectional areas of the openings 4 are related in accordance with the weights or codes of the MSB to LSB of the PCM signal as follows:

| | |
|---|---|
| Element 1A: | $2^{(N-1)}S$ |
| Element 1B: | $2^{(N-2)}S$ |
| . | |
| . | |
| . | |
| Element 1N: | $2^{(N-N)}S$ |

Where S is a unit area of a predetermined size.

As shown in FIG. 1, the inlets 3 of the throats 2*a* of the respective operational elements 1A to 1N are connected to a common fluid source for example, an air chamber 10. Each of the outlets 4 of the throats 2*a* of the pipes 2 is connected to the neck 9' of an exponential horn 9, and each of the outlets 5 of the throats 2*c* is connected through a drain pipe 11 to a common drain duct 12. The exponential horns 9 match the respective outlets 4 to space outside of the speaker body 1.

The fluid pipes 6 and 7 are connected through electric valves 21A to 21N and fluid pipes 8 to the common air chamber 10. An opening 13 through which a fluid such as air can enter the chamber 10 is provided in the speaker body 1, and a compression pump 14 is located in the opening 13 to maintain the fluid in the chamber 10 at a predetermined pressure. The drain duct 12 also extends into the opening 13 to allow the fluid that enters any of the throats 4 to be sent back to the chamber 10.

Figure 2:
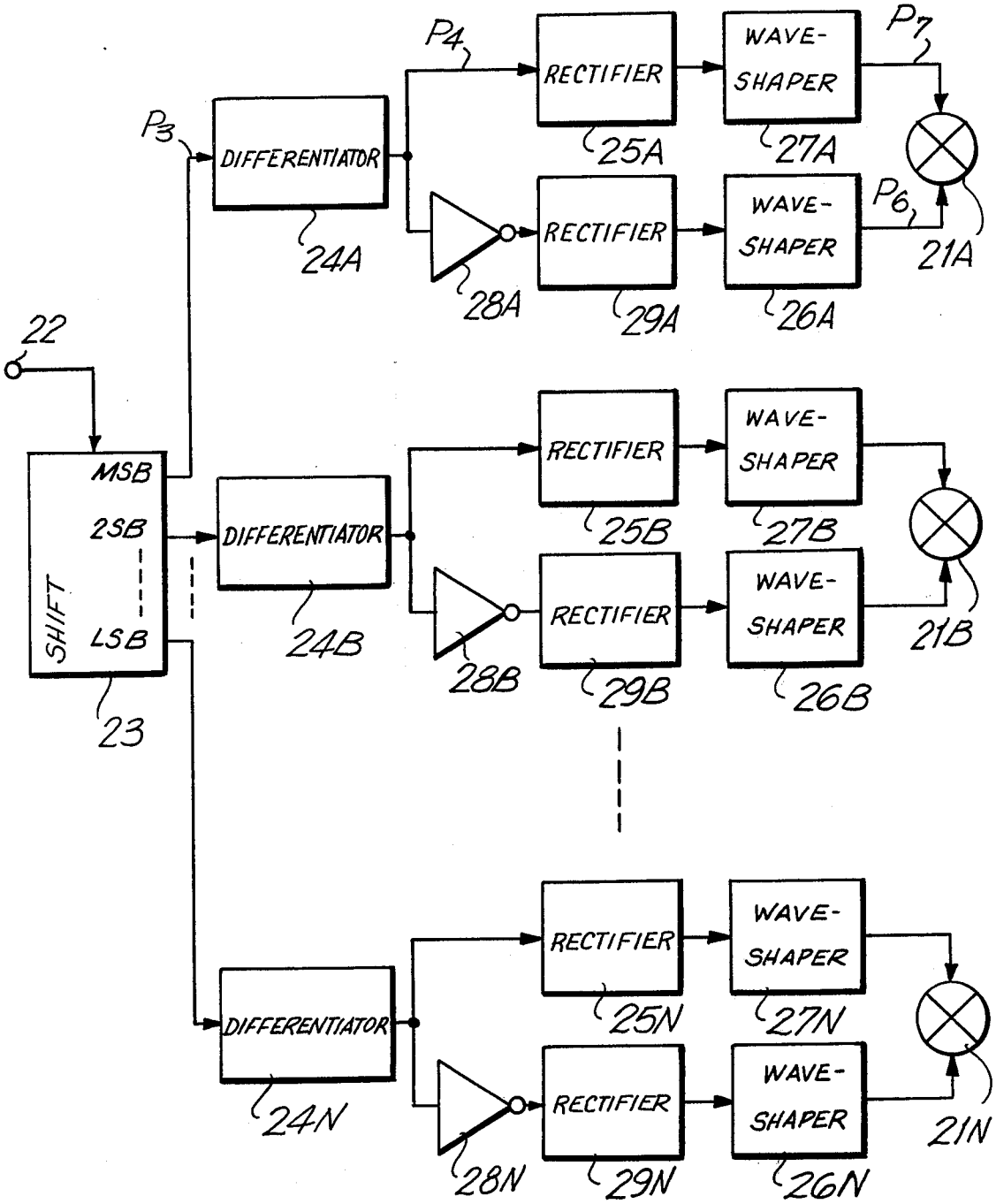
FIG. 2 is a block diagram showing a signal system to drive the speaker system shown in FIG. 1.
Figure 3C:
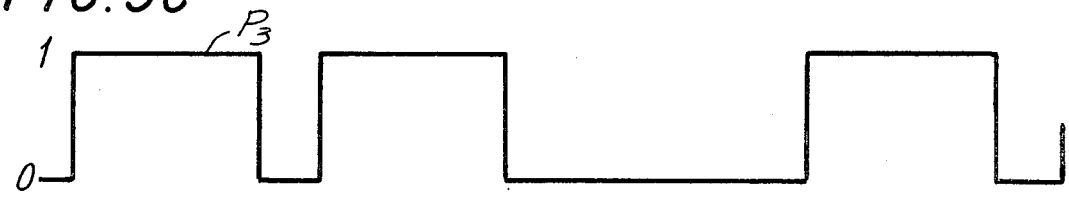
Figure 3D:
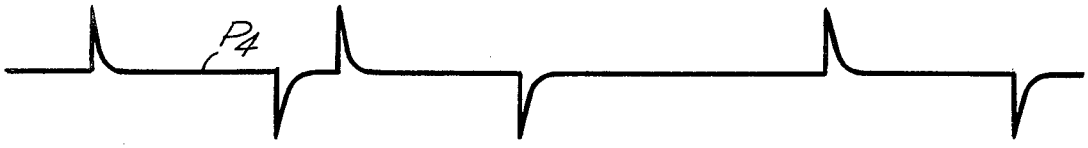
Figure 3E:
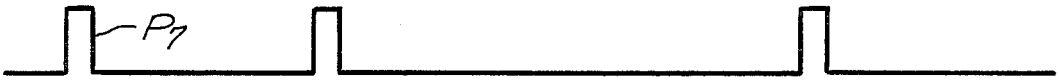
Figure 3F:
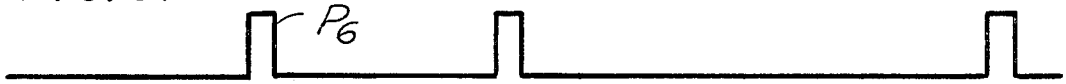

A circuit for controlling the electric valves 21A to 21B by means of a PCM pulse signal will be described with reference to FIG. 2. In FIG. 2, an input terminal 22 is supplied with the PCM pulse signal consisting of a series of pulses. The input N-bit PCM pulses are supplied through the input terminal 22 to a shift register 23 which converts the serial pulse input into a parallel output signal and holds the value of each of the MSB-LSB parallel output pulses constant for one frame. Thus the pulse signal $P_3$ based on the MSB pulses of four successive frame intervals is obtained from the shift register 23, as shown in FIG. 3C. The pulse signal $P_3$ is fed to a differentiation circuit 24A to produce a differentiated pulse signal $P_4$ shown in FIG. 3D, which is fed through a rectifying circuit 25A to a wave shaping circuit 27A to produce a pulse $P_7$ at the leading edge of each pulse in the pulse signal $P_3$, as shown in FIG. 3E. The signal $P_7$ is supplied to the electric valve 21A. The differentiated pulse signal $P_4$ is also supplied through an inverter 28A and a rectifying circuit 29A to a wave shaping circuit 26A to produce a pulse $P_6$ at the trailing edge of every pulse in the signal $P_3$, as shown in FIG. 3F. The resulting pulse signal $P_6$ is supplied to the same electric valve 21A as the pulse $P_7$.

Figure 3G:
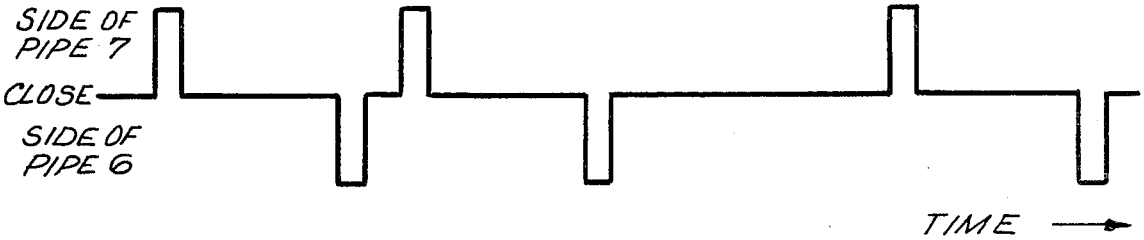

The electric valve 21A is controlled by the pulses $P_6$ and $P_7$ as shown in FIG. 3G. That is, the electric valve 21A is so controlled that during each time interval within which the pulse $P_6$ has a binary value "1", a fluid, such as air, is fed from the flow pipe 8 to the pipe 6, while during each time interval within which the pulse $P_7$ has the binary value "1", the air is fed from the pipe 8 to the pipe 7. Further, during the time intervals within which both the pulses $P_6$ and $P_7$ have the binary value "0", no air is fed to either the pipe 6 or the pipe 7 from the pipe 8.

Since the respective circuit constructions of the relations between the pulses derived by the shift register 23 from the 2SB to LSB signals of the PCM pulse signal $P_2$ in FIG. 3B and the electric valves 21B to 21N are same as that between the pulses derived from the MSB signal of the PCM pulse signal $P_2$ and the electric valve 21A as just described, their description will be omitted, but the corresponding circuit elements are shown with the same reference numerals followed by letters B to N, respectively.

With the speaker system of the invention constructed as above, the fluid such as air in the chamber 10 flows through the inlets 3 to the respective pipes 2. In this case, if the configuration of the cross-section of the pipes 2 and the condition of their walls are correct according to Coanda effect technology, the fluid passed through each of the pipes 2 will flow through only one of the outlets 5 or 4 at a time, as indicated by an arrow 36 or 37 in the operational element 1A.

As a starting point for the description of operation of the invention, it will be assumed that, in the operational element 1A, the air is flowing through the outlet 5 of the throat 2*c* as indicated by the arrow 36. Under such an assumption, when the pulse $P_3$ signal corresponding to the MSB signal of the PCM pulse signal $P_2$ is changed from "0" to "1", the pulse $P_7$ momentarily becomes "1" and the electric valve 21A is controlled by the pulse $P_7$ such that a small air current momentarily flows from the pipe 8 to the pipe 7. When this air is emitted from the pipe 7 to the pipe 2, the main air current flowing from the inlet 3 to the throat 2*c* of the pipe 2 and on through the outlet 5 as indicated by the arrow 36 is deflected, or lifted from the wall of the throat 2*c*, and is changed over to flow through the throat 2*b* as indicated by the arrow 37. Thereafter, the main air current flows through the outlet 4. Even after the pulse $P_7$ becomes "0" and the electric valve 21A is closed so as to feed no air to the pipe 7, the Coanda effect will cause the air from the opening 3 to continue to flow out through the outlet 4 to the horn 9.

Next, when the pulse signal $P_3$ drops to "0" from "1" at the end of the first frame, the pulse signal $P_6$ becomes "1". The electric valve 21A is controlled thereby to cause air to flow from the pipe 8 to the pipe 6 and on into the flow pipe 2. As a result, the main air current, which is flowing from the inlet 3 through the pipe 2 to the outlet 4 as indicated by the arrow 37, is triggered, or deflected, from the throat 2*b* back to the throat 2*c* and the outlet 5 by the small air current emitted from the pipe 6 into the pipe 2. Thereafter, even if the pulse signal $P_6$ becomes "0" so that the electric valve 21A is closed and no air can flow to the pipe 6 from the pipe 8, the main air current entering the pipe 2 from the inlet 3 continues to emerge through the outlet 5. In other words, when the pulse signal $P_3$ is "0", the air from the inlet 3 passes on out through the opening 5, while when the pulse signal $P_3$ is "1". the air from the inlet 3 passes out through the outlet 4.

The above operation described in connection with the MSB signal of the PCM pulse signal $P_2$ in FIG. 3B and the operational element 1A is the same as is carried out on the respective pairs of the 2SB to LSB signals of the PCM pulse signal $P_2$ by the operational elements 1B to 1N. Accordingly, when the PCM pulse signal $P_2$ is supplied to the input terminal 22, fluid flows, such as air flows, are produced through the outlet 4 of the operational elements 1A to 1N in accordance with the code of the PCM pulse signal at every frame thereof. As a result, a listener receives air pressure that is the sum of the air pressures of the respective air flows through the respective outlets 4. In this case, the respective air pressures are in proportion to the products of the cross-sectional areas of openings 4 and the air flow rates through the openings 4. In the example of the invention shown in FIG. 1, the air flow rate through the openings 4 are all the same, as previously described, and the cross-sectional areas of openings 4 are weighted in accordance with the weights of the MSB to LSB orders of the PCM pulse signal.

Therefore, when the listener receives the sum air pressure, this air pressure has a magnitude corresponding to the analog value of each frame of the PCM pulse. That is, the listener receives the air pressure in a PAM (pulse amplitude modulated) condition. In general, since the auditory system of a human being inherently has the characteristics of a low pass filter, the listener receives the air pressure in PAM contition as the sound pressure of the original audio signal $S_0$. Thus, an acoustic output by demodulating the PCM pulse can be obtained by the speaker system of this invention.

As described above, according to the speaker system of the present invention, the acoustic output can be obtained directly from the PCM pulse signal $P_2$. In this case, if the pressure of fluid such as air in the chamber 10 is increased or if the cross-sectional area of each outlet 4 is increased, an acoustic output, which becomes greater in proportion to the increased pressure or cross-sectional area, can be obtained. The power loss is a steady loss, mainly by the pump 14, so that the signal power is converted into the acoustic output with very high efficiency.

Further in accordance with the invention, the sound pressure produced from each section of the speaker is determined by whether the air flows through the outlet 4 or 5, so that the sound pressure can be cut off instantly by switching the air flow from the outlet 4 to the outlet 5, and hence, a sound pressure waveform substantially the same as that of the original sound can be produced.

The electric valves 21A to 21N may be of electrostriction or magnetostriction type, or other types of high speed elements, can be used and they can be provided in both the pipes 6 and 7 independently.

In the above example of the invention, the fluid operational elements 1A to 1N of the final stage are controlled directly by the air flows which are controlled by the electric valves 21A to 21N, respectively. However, it is possible for fluid amplifiers of a desired amplification to be interposed to reduce the required number of electric valves to as small a number as possible. The system can be arranged so that the same electric valve can be used for all the bits. In this case, it is necessary that a delay pipe be provided near the LSB channel so as to compensate for a delay time caused by the fluid amplifier.

Further, it is possible for a cylinder in which compressed fluid, such as air, is sealed to be used in place of the pump 14.

It is also possible that the air flow rate through each of the operational elements 1A to 1N is weighted and the system can be made to control the flow of liquid, such as water.

The above description is given on a single preferred embodiment of the present invention, but it will be apparent that many modifications and variations could be effected by one skilled in the art without departing from the true scope of the invention. Therefore, the scope of the invention should be determined by the following claims.

We claim as our invention:

1. A loudspeaker system responsive to a pulse-code modulated input signal having a plurality of bits ranging in order from a most significant bit to a least significant bit, comprising:

a plurality of flow pipes, each associated with a respective order of said bits and each having an inlet and an outlet for producing an acoustic output in response to a predetermined flow condition in the respective flow pipe;

a fluid source for supplying a fluid to each of said inlets;

control means for controlling said flow condition of the fluid through each of said flow pipes; and circuit means supplied with said pulse-code modulated input signal for actuating said control means of each of said flow pipes in response to the respective order of said bits of the input signal.

2. A loudspeaker system according to claim 1; in which said of said outlets includes an exponential horn for producing said acoustic output in response to fluid flow therethrough.

3. A loudspeaker system according to claim 1; further comprising pump means for maintaining fluid in said fluid source at a predetermined pressure.

4. A loudspeaker system according to claim 1; in which each of said flow pipes includes a second outlet and a common junction at which the first mentioned outlet and said second outlet are in communication through said inlet of the respective flow pipe with said fluid source.

5. A loudspeaker system according to claim 4; including drain pipe means connected between said fluid source and each of said second outlets of said flow pipes.

6. A loudspeaker system according to claim 4; in which said circuit means includes a shift register supplied with said pulse-code modulated signal for producing a plurality of pulse signals, each corresponding to the respective order of said bits, and a plurality of control pulse generating means, each supplied with a respective one of said pulse signals and each producing at least one respective control pulse for actuating said control means.

7. A loudspeaker system according to claim 6; in which each of said control pulse generating means includes a differentiator supplied with said respective one of said pulse signals and producing a differentiated output signal, a first control pulse generating circuit for producing a first control pulse, and a second control pulse generating circuit for producing a second control pulse, said first and second control pulses causing said control means to provide a fluid flow through said first and second outlets, respectively, of a respective one of said flow pipes.

8. A loudspeaker system according to claim 7; in which each of said first control pulse generating circuits includes a first rectifier supplied with said differentiated signal and producing a first rectified output signal, and a first wave-shaping circuit supplied with said first rectified output signal and producing said first control pulse; and each of said second control pulse generating circuits includes an inverter supplied with said differentiated output signal and producing an inverted output signal, a second rectifier supplied with said inverted output signal and producing a second rectified output signal, and a second wave-shaping circuit supplied with said second rectified output signal and producing said second control pulse.

9. A loudspeaker system according to claim 4; in which said control means includes first and second fluid control pipe means connected to each of said common junctions for controlling the flow of fluid through said first and second outlets of the respective one of said flow pipes; and a plurality of valve means, each connecting a respective one of said first and second fluid control pipe means to a fluid supply for selectively supplying fluid to said first and second fluid control pipe means of said respective one of said plurality of first and second fluid control pipe means.

10. A loudspeaker system according to claim 9; in which said fluid supply is said fluid source.

11. A loudspeaker system according to claim 9; in which said control means further includes connecting fluid pipe means connected between each of said valve means and said fluid supply.

* * * * *